US009405247B2

(12) United States Patent
Kondo

(10) Patent No.: US 9,405,247 B2
(45) Date of Patent: Aug. 2, 2016

(54) FIXING DEVICE AND IMAGE FORMING APPARATUS

(71) Applicant: Tomohiro Kondo, Nagoya (JP)

(72) Inventor: Tomohiro Kondo, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 2 days.

(21) Appl. No.: 14/171,902

(22) Filed: Feb. 4, 2014

(65) Prior Publication Data

US 2014/0294459 A1 Oct. 2, 2014

(30) Foreign Application Priority Data

Mar. 29, 2013 (JP) ..... 2013-071975

(51) Int. Cl.
*G03G 15/20* (2006.01)

(52) U.S. Cl.
CPC ..... *G03G 15/206* (2013.01); *G03G 2215/2009* (2013.01); *G03G 2215/2035* (2013.01)

(58) Field of Classification Search
None
See application file for complete search history.

(56) References Cited

U.S. PATENT DOCUMENTS

| | | | | |
|---|---|---|---|---|
| 5,812,906 | A | 9/1998 | Staudenmayer et al. | |
| 7,113,716 | B2 | 9/2006 | Tomatsu | |
| 7,970,330 | B2 * | 6/2011 | Condello | G03G 15/2053 399/329 |
| 8,208,833 | B2 | 6/2012 | Kitagawa | |
| 8,463,150 | B2 | 6/2013 | Yoshikawa | |
| 2004/0234290 | A1 | 11/2004 | Tomatsu | |
| 2006/0093418 | A1 * | 5/2006 | Watanabe | G03G 15/2064 399/329 |
| 2007/0025784 | A1 * | 2/2007 | Ito | G03G 15/2064 399/329 |
| 2007/0258725 | A1 * | 11/2007 | Hayashi | 399/70 |
| 2010/0272458 | A1 | 10/2010 | Yoshikawa | |
| 2012/0057910 | A1 * | 3/2012 | Matsumoto | 399/329 |

FOREIGN PATENT DOCUMENTS

| | | |
|---|---|---|
| JP | 60-151681 | 8/1985 |
| JP | 62-014675 A | 1/1987 |
| JP | H02-222980 A | 9/1990 |
| JP | 2004-279702 A | 10/2004 |
| JP | 2007-155848 A | 6/2007 |
| JP | 2010-256696 A | 11/2010 |

OTHER PUBLICATIONS

Co-Pending U.S. Appl. No. 14/171,915, filed Feb. 4, 2014.
Nov. 24, 2014—(US) Non-Final Office Action—U.S. Appl. No. 14/171,915.

* cited by examiner

*Primary Examiner* — David Gray
*Assistant Examiner* — Geoffrey Evans
(74) *Attorney, Agent, or Firm* — Banner & Witcoff, Ltd.

(57) ABSTRACT

A fixing device includes a heater, a first endless belt, a first back up member, and a second back up member. The first endless belt provides a nip region upon contacting with the heater, and is movable in a first direction. The first back up member provides a first position where the first back up member nips the first endless belt in cooperation with the heater. The first endless belt and the heater provide a first contact pressure at the first position. The second back up member is positioned downstream of the first back up member in the first direction, and provides a second position where the second back up member nips the first endless belt in cooperation with the heater. The first endless belt and the heater provide a second contact pressure at the second position; the first contact pressure is higher than the second contact pressure.

18 Claims, 8 Drawing Sheets

FIXING DEVICE AND IMAGE FORMING APPARATUS

CROSS REFERENCE TO RELATED APPLICATION

This application claims priority from Japanese Patent Application No. 2013-071975 filed Mar. 29, 2013. The entire content of the priority application is incorporated herein by reference.

TECHNICAL FIELD

The present invention relates to a fixing device that thermally fixes a transferred developing agent image to a sheet and an image forming apparatus including the fixing device.

BACKGROUND

Japanese Patent Application Publication No. S62-14675 discloses a fixing device including a heater, a pressure belt providing a nip region in cooperation with the heater, and two rollers supporting an inner peripheral surface of the pressure belt. The pressure belt is nipped between the heater and each of the two rollers, which are disposed at an entry position and an exit position of sheets. Therefore, an enlarged nipping region can be provided, and contacting width between the sheet and the heater can be increased, whereupon enhanced heating efficiency can be obtained.

SUMMARY

In the nip region, if the contact pressure between the pressure belt and the heater is insufficient, sheet slippage relative to the pressure belt may occur at an entry position of the nip region. Therefore, an increase in contact pressure between the pressure belt and the heater is required.

One possible solution is to increase the contact pressure between the heater and the pressure belt. To this effect, pressing the heater against the pressure belt is required over an entire area of the belt between the rollers. That is, load application is required on the nip region, i.e. the entire range between the two rollers. However, if a heavy load is applied on the heater in order to further increase the contact pressure against the pressure belt at the sheet entry position, almost the same amount of the load at the sheet entry may be applied on the sheet exit position, because the two rollers are disposed to support the load almost equally. As a result, the load applied on the entire fixing device may become larger, and the fixing device may require complicated structure.

Therefore, the object of the present invention is to provide a fixing device with a simple structure that prevents a failure of sheet conveyance at the sheet entry position, and to provide an image forming apparatus including the fixing device.

In order to attain the above and other objects, the present invention provides a fixing device that includes a heater, a first endless belt, a first back up member, and a second back up member. The first endless belt provides a nip region upon contacting with the heater, and is movable in a first direction at the nip region. The first back up member provides a first position where the first back up member is configured to nip the first endless belt in cooperation with the heater. The first endless belt and the heater provide a first contact pressure at the first position. The second back up member is positioned downstream of the first back up member in the first direction and spaced away therefrom. The second back up member provides a second position where the second back up member is configured to nip the first endless belt in cooperation with the heater. The first endless belt and the heater provide a second contact pressure at the second position; the first contact pressure is higher than the second contact pressure.

DETAILED DESCRIPTION

Figure 1:
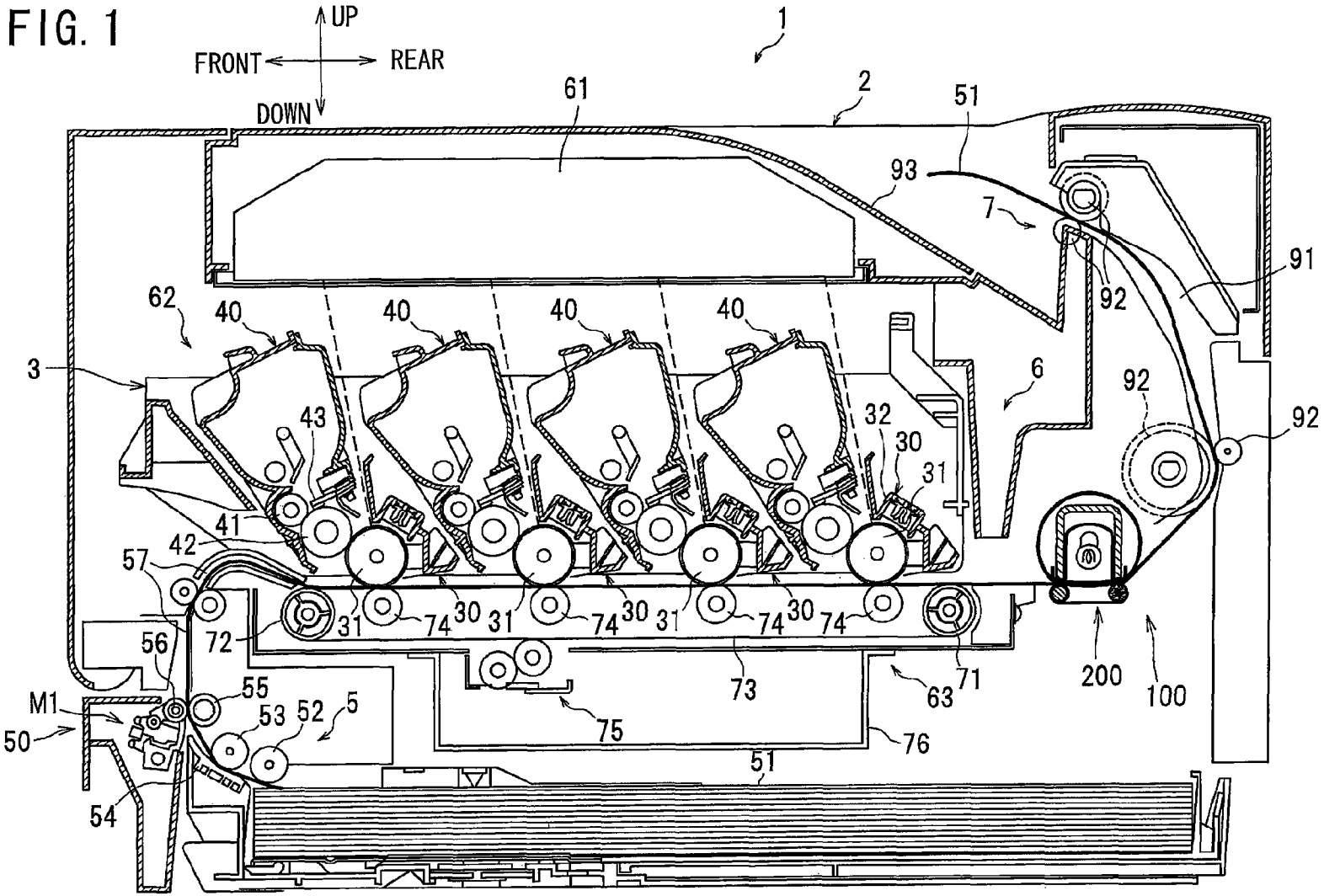
FIG. 1 is a schematic cross-sectional view showing a structure of a color laser printer having a fixing device according to one embodiment of the present invention.

A fixing device according to an embodiment of the present invention will be described in detail with reference to the accompanying drawings. As shown in FIG. 1, the color laser printer 1 includes a main frame 2, a sheet supplying unit 5 for supplying a sheet 51 as a recording medium, an image forming unit 6 for forming an image on the sheet 51, and a sheet discharge unit 7 for discharging a sheet on which an image has been formed.

Incidentally, in the following description, unless otherwise stated, the vertical direction of FIG. 1 is referred to as a vertical direction; the left side of FIG. 1 is referred to as front, and the right side as rear; and the back side of the paper surface is referred to as left, and the front side of the paper surface as right. In this manner, each of the directions is indicated. In this case, the left and the right are defined based on the directions in which a person standing in front of a color laser printer 1 is viewing.

General Structure of Laser Printer

The sheet supplying unit 5 includes a sheet supply tray 50 and a sheet supplying mechanism M1. The sheet supply tray 50 is mounted in the main frame 2 and is detachable from the main frame 2 at a front side thereof by a sliding operation. The sheet supplying mechanism M1 is configured for lifting the sheets 51 from a front side of the sheet supply tray 50 in a diagonally upward and frontward direction and then reversing the sheet 51 rearward.

The sheet supplying mechanism M1 is disposed near the front end portion of the sheet supply tray 50, and includes a pick-up roller 52, a separation roller 53, a separation pad 54, a paper dust removing roller 55, and a pinch roller 56. A conveying path 57 is provided above the sheet supplying mechanism M1, and a conveyer belt 73 is provided above the sheet supply tray 50 and downstream of the conveying path 57.

An uppermost sheet 51 of a sheet stack on the sheet supply tray 50 is separated in an upward direction through cooperative operation of the pick-up roller 52, the separation roller 53, and the separation pad 54. As the sheet 51 fed in the upward direction passes between the paper dust removing roller 55 and the pinch roller 56, paper dust is removed from the sheet 51. Then, the sheet 51 is conveyed along the conveying path 57 while the conveying direction of the sheet 51 is changed to a rearward direction. Subsequently, the sheet 51 is conveyed onto the conveyor belt 73.

The image forming unit 6 includes a scanning unit 61, a process unit 62, a transfer unit 63, and a fixing device 100. The scanning unit 61 is disposed in an upper section of the main frame 2, and includes four sub-scanning units each corresponding to one of four colors cyan, magenta, yellow, and black. Although not shown in the drawings, each of the sub-scanning units includes a laser emitting section, a polygon mirror, a plurality of lenses, and a reflecting mirror. The laser emitting section emits a laser beam, which is scanned at a high speed by the polygon mirror in the left-to-right direction and passes through and is reflected by the plurality of lenses and the reflecting mirror so as to irradiate a surface of a corresponding photosensitive drum 31 described later.

The process unit 62 is disposed below the scanning unit 61 and above the sheet supplying unit 5, and includes a drum unit 3. The drum unit 3 has four sub-drum units 30 and four developing cartridges 40 corresponding to the sub-drum units 30.

Each sub-drum unit 30 includes the photosensitive drum 31 and a scorotron charger 32. Each developing cartridge 40 includes a toner supply roller 41, a developing roller 42, and a doctor blade (toner layer thickness regulation blade) 43, and accommodates therein toner of specific color.

During the image forming operation, the toner in the developing cartridges 40 is supplied to the developing roller 42 via the toner supply roller 41. In this case, the toner is charged with a positive polarity by triboelectric charging. The toner conveyed on the developing roller 42 becomes a thin layer having a uniform thickness by the doctor blade 43 in accordance with the rotation of the developing roller 42.

In the sub-drum units 30, the surface of the photosensitive drum 31 is uniformly charged with a positive polarity by the scorotron charger 32, Then, the surface is subjected to high speed scan of the laser beam from the scanning unit 61 based on the image data. Thus, an electrostatic latent image is formed on the surface of the photosensitive drum 31.

The developing roller 42 supplies the toner onto the electrostatic latent image on the rotating photosensitive drum 31; the latent image has been formed by the discharge of the positively charged surface as a result of the exposure to the laser beam. Thus, the reversal development process is carried out in which the photosensitive drum 31 obtains a visible toner image formed of each color of the toner; in other words, the electrostatic latent image is converted into a toner color image.

The transfer unit 63 includes a drive roller 71, a driven roller 72, the conveyor belt 73, a plurality of transfer rollers 74, and a cleaning unit 75. The drive roller 71 and the driven roller 72 are disposed in parallel with and separated from each other. The conveyor belt 73 is an endless belt disposed over the drive roller 71 and the driven roller 72. An outer surface of the conveyor belt 73 serves as a conveying surface and contacts each of the photosensitive drums 31. The transfer rollers 74 are disposed in opposition to the corresponding photosensitive drums 31 via the conveyor belt 73, and are applied with transfer bias from a high-voltage circuit board (not shown). During the image forming operation, the conveyor belt 73 conveys the sheet. Subsequently, the sheet 51 conveyed by the conveyor belt 73 is nipped between the photosensitive drum 31 and the transfer roller 74 via the conveyor belt 73, whereby a toner image is transferred from the photosensitive drum 31 onto the sheet 51.

The cleaning unit 75 is disposed below the conveyor belt 73 for removing toner adhered to the conveyor belt 73. A toner accumulation section 76 is disposed below the cleaning unit 75 for accumulating toner removed by the cleaning unit 75.

The fixing device 100 is disposed rearward of the transfer unit 63. The toner image transferred onto the sheet 51 is thermally fixed thereon as the sheet 51 passes through the fixing device 100 (described later).

In the sheet discharge unit 7, a paper-discharge-side conveying path 91 is so formed as to extend upward from an outlet of the fixing device 100 and to make a turn to the front side. A plurality of conveying rollers 92 for conveying the sheet 51 is disposed on the paper-discharge-side conveying path 91. A discharge tray 93 is provided on the upper surface of the main frame 2 for accommodating the sheet 51 discharged from the paper-discharge-side conveying path 91.

Detailed Configuration of Fixing Device

Figure 2A:
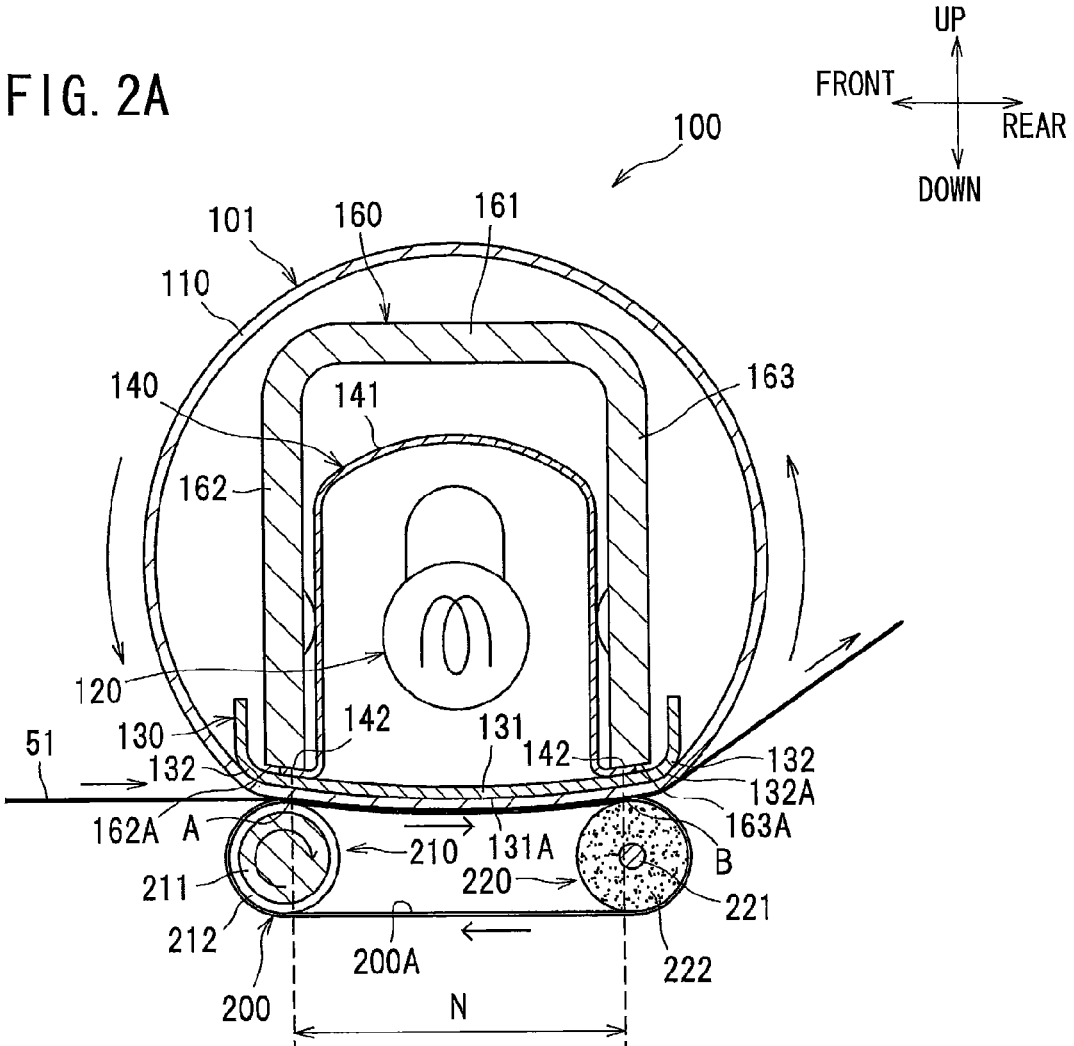
FIG. 2A is a schematic cross-sectional view of the fixing device according to the embodiment.
Figure 4:
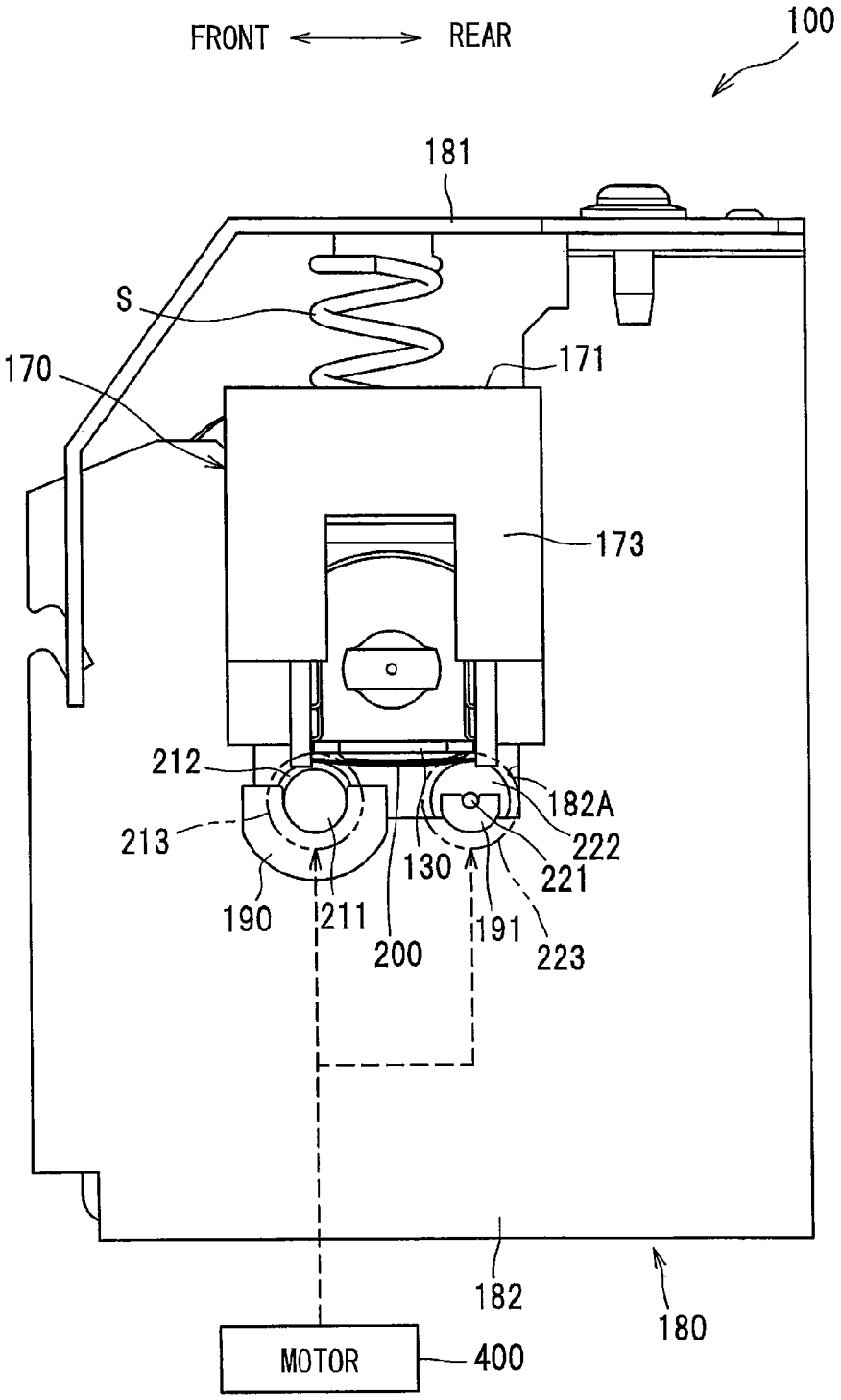
FIG. 4 is a right side view of the fixing device according to the embodiment.

As shown in FIG. 2A, the fixing device 100 includes a heater 101, a pressure belt 200, and a fixing frame 180 that supports the above components (See FIG. 4). The pressure belt 200 will be described later.

Figure 3A:
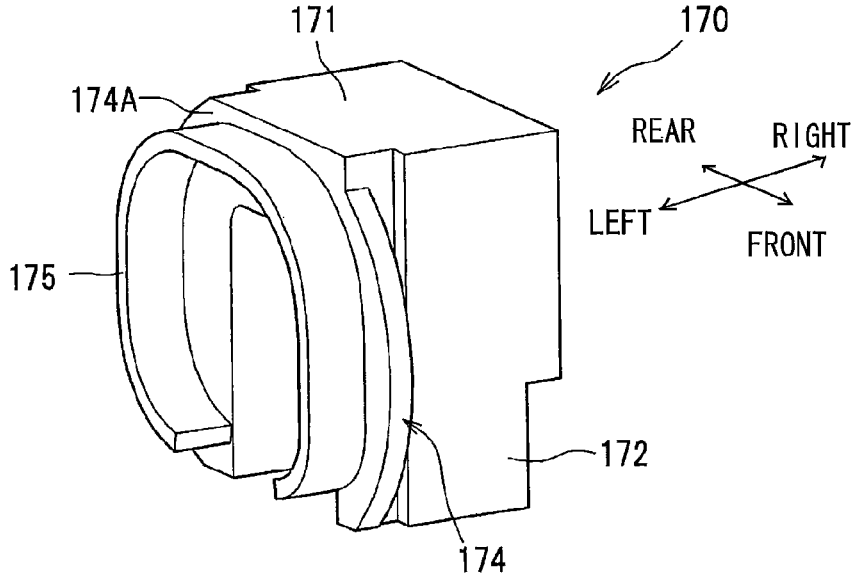
FIG. 3A is a perspective view, as viewed from above, of a regulating member in the fixing device according to the embodiment.

The heater 101 includes a fusing belt 110, a halogen lamp 120, a nip plate 130, a reflection plate 140, a stay 160, and a regulating member 170 (See FIG. 3A).

The fusing belt 110 is an endless belt that has heat resistance and flexibility. The fusing belt 110 is so formed as to come in contact with the pressure belt 200 (described later) and to follow the motion of the pressure belt 200. The fusing belt 110 includes a metal element tube that is made of stainless steel or any other metal. The fusing belt 110 may include a rubber layer formed over a surface of the metal element tube, and may further include a nonmetallic release layer such as fluorine coating formed over a surface of the rubber layer. Incidentally, the fusing belt 110 of the present embodiment follows only the motion of the pressure belt 200, and is not driven by other members.

The halogen lamp 120 is a heating element that heats the toner on the sheet 51 by heating the nip plate 130 and the fusing belt 110. On the internal space of the fusing belt 110, the halogen lamp 120 is disposed away from the inner surface of the fusing belt 110 and nip plate 130 by predetermined intervals.

The nip plate 130 is a plate-like member that receives radiation heat from the halogen lamp 120. The fusing belt 110 is nipped between the pressure belt 200 and the nip plate 130. The nip plate 130 conveys the radiation heat received from the halogen lamp 120 to the toner on the sheet 51 via the fusing belt 110.

The nip plate 130 has a generally U-shaped cross-section and is made from a material such as aluminum having a thermal conductivity higher than that of the stay 160 (described later) made from steel. More specifically, for fabricating the nip plate 130, an aluminum plate is bent into substantially U-shape to provide a base section 131 and bent sections 132. When viewed in cross-section, the base section 131 extends in the frontward/rearward direction (or direction in which the pressure belt 200 moves), and the bent sections 132 are bent upward from both ends of the base section 131. The bottom of the base section 131 provides a base surface 131A in contact with the pressure belt 200, and each bent section 132 has a bent surface 132A in contact with the pressure belt 200. Each bent surface 132A has a radius of curvature smaller than that of the base surface 131A.

The reflection plate 140 is adapted to reflect radiant heat from the halogen lamp 120 (most of the radiant heat is emitted in the frontward/rearward direction and in an upward direction) toward the nip plate 130 (an inner surface of the base section 131). As shown in FIG. 2, the reflection plate 140 is positioned in the internal space of the fusing belt 110 and surrounds the halogen lamp 120 with a predetermined distance therefrom.

Thus, radiant heat from the halogen lamp 120 can be efficiently concentrated onto the nip plate 130 to promptly heat the nip plate 130 and the fusing belt 110.

The reflection plate 140 has a substantially U-shaped cross-section and is made from a material such as aluminum having high reflection ratio regarding infrared rays or far infrared rays. The reflection plate 140 has a substantially U-shaped reflection portion 141 and a flange sections 142 extending outward from each end portion of the reflection portion 141 in the frontward/rearward direction. A mirror surface finishing is applicable on the surface of the reflection portion in order to enhance the heat reflection ratio of the reflection plate 140.

The stay 160 is a member that ensures rigidity of the nip plate 130 by supporting both ends of the base section 131 of the nip plate 130 in the frontward/rearward direction through the flange sections 142 of the reflection plate 140. The stay 160 is placed opposite to the pressure belt 200 with respect to the nip plate 130. The stay 160 has a substantially U-shaped cross-section, including an upper wall 161, a front wall 162, and a rear wall 163. The front wall 162 extends downward from the front end of the upper wall 161, and the rear wall 163 extends downward from the rear end of the upper wall 161. The stay 160 is so disposed as to cover the reflection plate 140. The stay 160 is formed by bending a steel plate or any other plate having high rigidity into a U-shape.

Figure 3B:
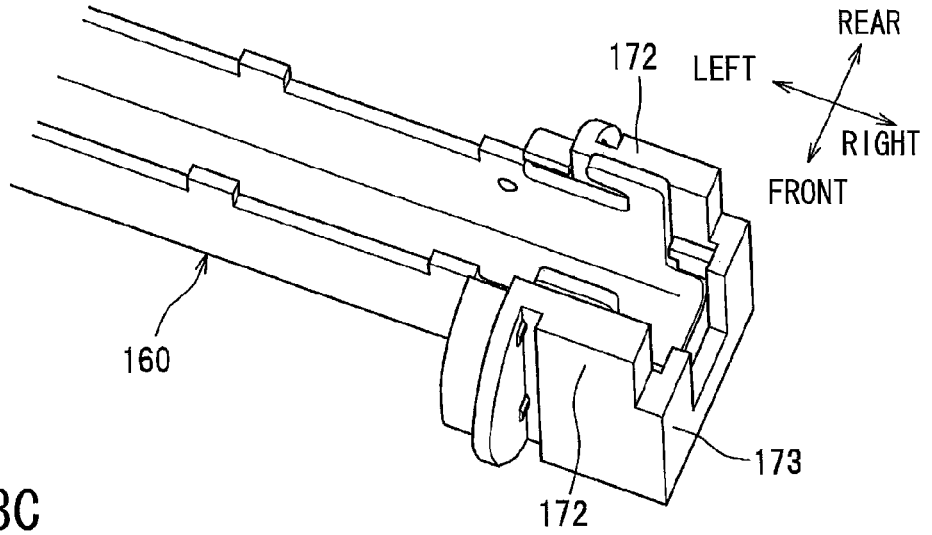
FIG. 3B is a perspective view, as viewed from below, of the regulating member and a stay assembled therewith in the fixing device according to the embodiment.
Figure 3C:
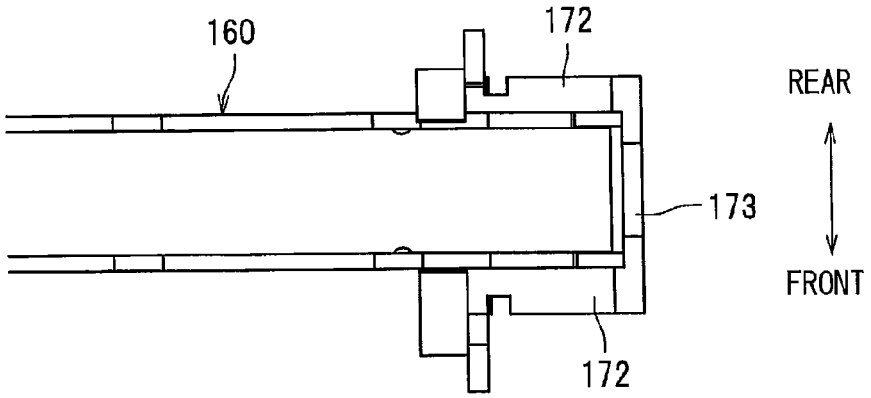
FIG. 3C is a bottom view of the regulating member and the stay assembled therewith in the fixing device according to the embodiment.

The stay 160 holds the nip plate 130 and the reflection plate 140 at a lower surface 162A of the front wall 162 and at a lower surface 163A of the rear wall 163. The stay 160 and the halogen lamp 120 are fixed to the left and the right regulating members 170 as shown in FIGS. 3A, 3B, and 3C. Alternatively, the halogen lamp 120 can be fixed to the fixing frame 180.

Each of the regulating members 170 is disposed at each of the widthwise end portions of the fusing belt 110 for regulating the movement of the fusing belt 110 in the leftward/rightward direction. Incidentally, in the following description, only the right regulating member 170 will be described, because the left regulating member 170 has the structure the same as the right regulation member.

More specifically, the regulating member 170 includes an upper wall 171, a pair of side walls 172, and a holding wall 173. The side walls 172 extend downward from both the front and the rear end portions of the upper wall 171, and the holding wall 173 extends downward from an outer end portion of the upper wall 171 in the rightward/leftward direction. The regulating member 170 holds the stay 160 so that the upper wall 171, the pair of side walls 172, and the holding wall 173 surround the stay 160.

Moreover, the regulating member 170 includes a belt regulating section 174, and a guide portion 175. The belt regulating section 174 is arcuate shaped that protrudes outward in the frontward/rearward direction from inner end portions of the pair of side walls 172 in the frontward/rearward direction. The belt regulating section 174 includes a belt regulating surface 174A at an inner side in the leftward/rightward direction for restricting movement of the fusing belt 110 in the leftward/rightward direction.

The guide portion 175 is a rib protruding inward from the belt regulating surface 174A in the leftward/rightward direction. The guide portion 175 has a C-shaped section with an opening at its lower side. The guide portion 175 is adapted to extend into the fusing belt 110 to suppress radially inward deformation of the fusing belt 110. Incidentally, the shape of the regulating member 170 is not limited to the shape described above, but the regulating member 170 can be formed into any shape.

As shown in FIG. 4, the regulating member 170 is supported by the fixing frame 180 so as to be movable in a vertical direction. The fixing frame 180 includes an upper frame 181 and a lower frame 182. On the upper frame 181, a coil spring S is provided so as to urge the regulating member 170 downward or against the pressure belt 200. The coil spring S is adapted to press the upper wall 171 in the downward direction. As a result, the pressure belt 200 is pressed against the first roller 210 and the second roller 220. Thus, the pressure belt 200 is pressed against the fusing belt 110 by the reaction force from the first and second rollers 210 and 220.

Substantially U-shaped support grooves 182A is formed on each of the left and right walls of the lower frame 182 for supporting the regulating member 170 so that the regulating member 170 is movable in the vertical direction. A bearing 190 for supporting a first shaft 211 of a first roller 210 (described later) and a bearing 191 for supporting a is second shaft 221 of a second roller 220 (described later) are provided on the front side of the bottom portion of the support groove 182A.

Configuration of Pressure Belt

As shown in FIG. 2A, the pressure belt 200 is an endless belt that faces the fusing belt 110 and is in contact with the fusing belt 110, thereby forming a nip region N. A portion of the pressure belt 200 that faces the fusing belt 110 is so configured as to move rearward.

The pressure belt 200 is made from a resin such as polyimide resin. An inner peripheral surface 200A of the pressure belt 200 is supported by the first roller 210 and the second roller 220. Incidentally, all that is required for the pressure belt 200 is to contain resin.

The first roller 210 faces the fusing belt 110. The pressure belt 200 is held between the first roller 210 and the fusing belt 110 at a position A. The pressure belt 200 and the fusing belt 110 are held between the first roller 210 and the front side of the base surface 131A, wherein the front side is an upstream side of the base surface 131A in the running direction of the pressure belt 200.

More specifically, the first roller 210 is disposed at a position where the lower surface 162A supports the base section 131, or is aligned with the front wall 162 in the frontward/rearward direction. The nip plate 130, the pressure belt 200, and the fusing belt 110 are held between the first roller 210 and the lower surface 162A of the stay 160. Moreover, the lower surface 162A and the first position A at which the first roller 210 is in contact with the pressure belt 200 are aligned with each other in the vertical direction.

The first roller 210 is coupled to a first gear 213 as shown in FIG. 4, which is driven by a motor 400 disposed outside. The first roller 210 includes a first shaft 211 made from metal and a first elastic layer 212 made from rubber and formed over an outer peripheral surface of the first shaft 211. The first elastic layer 212 has a thickness smaller than that of a second elastic layer 222 (described later). Therefore, when the pressure belt 200 is nipped between the first roller 210 and the nip plate 130, the reaction force of the first elastic layer 212 is greater than that of the second elastic layer 222. Thus, the pressing force of the first roller 210 is larger than the pressing force of the second roller 220. This means that the contact pressure between the pressure belt 200 and the fusing belt 110 at the first position A is larger than the contact pressure between the pressure belt 200 and the fusing belt 110 at a second position B (described later). Consequently, slippage of the sheet 51 relative to the pressure belt 200 at the first position A can be more reliably prevented.

Incidentally, the thickness of the first elastic layer 212 may be in the range of 0.01 to 10.00 mm, or in the range of 0.1 to 5.00 mm, or in the range of 0.15 to 3.00 mm. The thickness of the second elastic layer 222 may be in the range of 0.10 to 40.00 mm, or in the range of 2.0 to 20.00 mm, or in the range of 5.00 to 15.00 mm.

As shown in FIG. 2A, the second roller 220 is positioned rearward (downstream in the running direction of the pressure belt 200) of the first roller 210. The pressure belt 200 is nipped between the second roller 220 and the fusing belt 110 at the second position B remote from the first position A. More specifically, the second roller 220 is disposed at the position where the lower surface 163A supports the base section 131, i.e. at the same position as the rear wall 163 in the frontward/rearward direction. The second roller 220 nips the nip plate 130, the pressure belt 200 and the fusing belt 110 in cooperation with the lower surface 163A. When viewed in the upward/downward direction, the lower surface 163A and the contacting portion at which the second roller 220 is in contact with the pressure belt 200, i.e. second position B, are aligned with each other.

Since the second roller 220 is disposed away from the first roller 210 by predetermined interval, the pressure belt 200 is in contact with the fusing belt 110 in the frontward/rearward range extending from the front wall 162 to the rear wall 163. Hence, a nip region N can be formed in that range, and can be extended wider in the frontward/rearward direction. According to the present embodiment, when the fusing belt 110 is not in contact with the pressure belt 200, e.g. when the fixing device 100 is not yet assembled or when the heater 101 is separated from the pressure belt 200 due to sheet-jam processing, an upper end of the first roller 210 is at the same height as an upper end of the second roller 220 in the upward/downward direction.

The second roller 220 includes a second shaft 221 made from metal and the second elastic layer 222 made from a thermal insulation material such as foamable sponge and formed over an outer peripheral surface of the second shaft 221. Because the second elastic layer 222 is a foamable elastic layer whose reaction force is smaller than that of the rubber layer of the first roller 210, the contact pressure at the second position B is smaller than that at the first position A. Consequently, the contact pressure at the first position A is larger than that at the second position B.

As shown in FIG. 4, the second roller 220 is coupled to a second gear 223, which is driven by the motor 400. The circumferential velocity of the second roller 220 is set greater than that of the first roller 210 in operation. Incidentally, such velocity difference can be set by setting a first reduction ratio of a gear train for driving the first gear 213 greater than a second reduction ratio of a gear train for driving the second gear 223 such that the circumferential velocity of the second gear 223 can be greater than that of the first gear 213. Alternatively, such velocity difference can be provided by connecting each dedicated motor to each of the gears 213, 223. In the latter case, the circumferential velocity of the motor connected to the second gear 223 is greater than that of the other motor connected to the first gear 213.

Figure 2B:
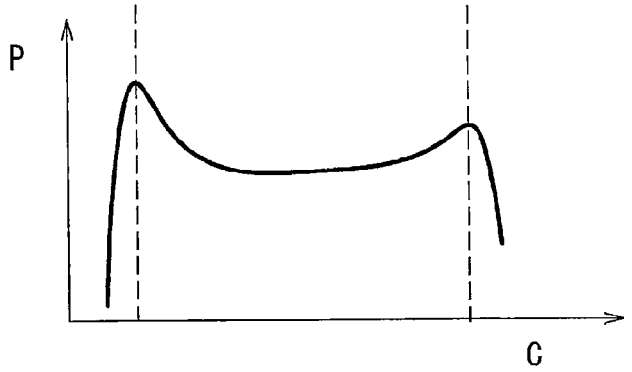
FIG. 2B is a graph indicating a distribution of a contact pressure P at a contact position C between a heating device and a fusing belt in a frontward/rearward direction.

With the structure thus constructed, as the coil spring S presses the heater 101 downward, the fusing belt 110 is in contact with the pressure belt 200, forming the nip region N. Further, the pressure belt 200 is pressed against the fusing belt 110 by the first and second rollers 210, 220. Therefore, as shown in FIG. 2B, appropriate contact pressure (shown as P) can be maintained across the entire nip region N at a contact position (shown as C).

Moreover, the first roller 210 and the second roller 220 are pressed against the pressure belt 200 at the first position A and at the second position B. Therefore, the contact pressure at the positions A and B is higher than at a remaining position in the nip region N. Here, assuming that the contact pressure between the pressure belt 200 and fusing belt 110 at the first position A is the same as the contact pressure between the pressure belt 200 and fusing belt 110 at the second position B. In the latter case, in an attempt to increase the contact pressure at the sheet entry position (first position A) and the sheet exit position (second position B), a total load applied to the entire nip region N must be increased. As a result, the load applied to the entire fixing device 100 becomes larger, which makes the structure of the fixing device more complex.

According to the present embodiment, the contact pressure of the second roller 220 is lower than the contact pressure of the first roller 210. Therefore, in comparison with the structure in which the contact pressure at the first position is the same as the second position, the contact pressure to be applied to the entire nip region N does not have to be increased. Consequently, the simplified structure of the entire fixing device 100 can be provided, because, for example, the urging force of the coil spring S can be smaller.

Further, since the circumferential velocity of the second roller 220 is set greater than that of the first roller 210, the rotation of the second roller 220 pulls an upper portion of the pressure belt 200 rearward. As a result, sufficient tension can be applied to an upper portion of the pressure belt 200, or a portion of the pressure belt 200 in contact with the fusing belt 110 to avoid deflection of the upper portion.

Further, the nip plate 130, the pressure belt 200, and the fusing belt 110 are nipped not only between the first roller 210 and the lower surface 162A, but also between the second roller 220 and the lower surface 163A. Therefore, the contact pressure between the pressure belt 200 and the fusing belt 110 can be increased at the first and second positions A and B.

Further, the pressure belt 200 contains resin, thereby providing lower thermal conductivity of the pressure belt 200, in comparison with a pressure belt made exclusively from metal. Consequently, the pressure belt 200 made from resin can restrain heat removal from the heater 101 while maintaining durability.

Further, the area of the nip region N can be increased, resulting in an improvement in heating efficiency in the nip region N.

Second Embodiment

A fixing device 100A according to a second embodiment of the present invention will be described with reference to FIGS. 5A and 5B, wherein like parts and components are designated by the same reference numerals and characters as those shown in the first embodiment.

According to the first embodiment, the first elastic layer 211 has a thickness smaller than that of the second elastic layer 222, and the first elastic layer 212 is a rubber layer whereas the second elastic layer 222 is a foamable elastic layer. Thus, the contact pressure at the first position A is higher than that at the second position B. In contrast, according to the second embodiment as shown in FIG. 5A, when a fusing belt 110 is not in contact with a pressure belt 200, or for example when the fixing device 100A is not yet assembled or when a heater 101A is separated from the pressure belt 200 due to sheet jam processing, a first roller 210A is configured higher than a second roller 220A. Incidentally, the direction from the first roller 210A to the fusing belt 110, or upward direction, is one example of a second direction.

The first roller 210A has a first shaft 211A made from metal, and a first elastic layer 212A made from rubber. The second roller 220A has a second shaft 221A made from metal, and a second elastic layer 222A made from rubber. The first shaft 211A has a diameter larger than that of the second shaft 221A; the first elastic layer 212A has a thickness equal to that of the second elastic layer 222A. Incidentally, the first elastic layer 212A and the second elastic layer 222A can be foamable elastic layers. Alternatively, the thickness of the first elastic layer 212A can be equal to that of the second elastic layer 222A, and the diameter of the first roller 210A can be equal to that of the second roller 220A. In the latter case, the first roller 210A is positioned higher than the second roller 220A in the vertical direction.

Figure 5A:
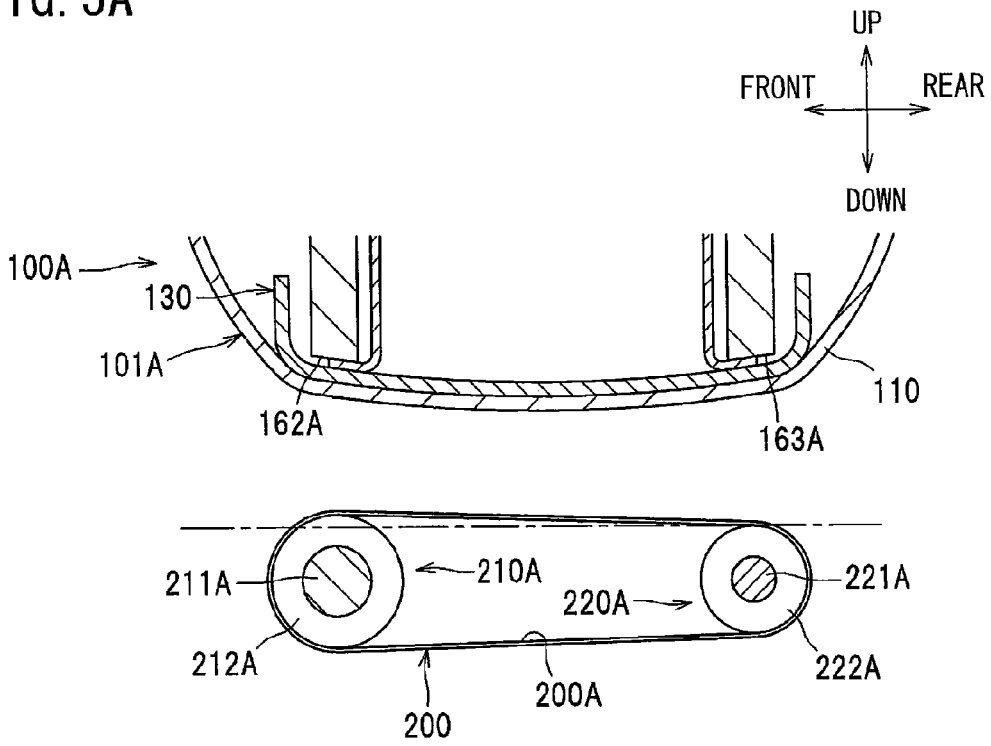
FIG. 5A is a partial cross-sectional view of the fixing device as the fusing belt is not in contact with a pressure belt according to a second embodiment.
Figure 5B:
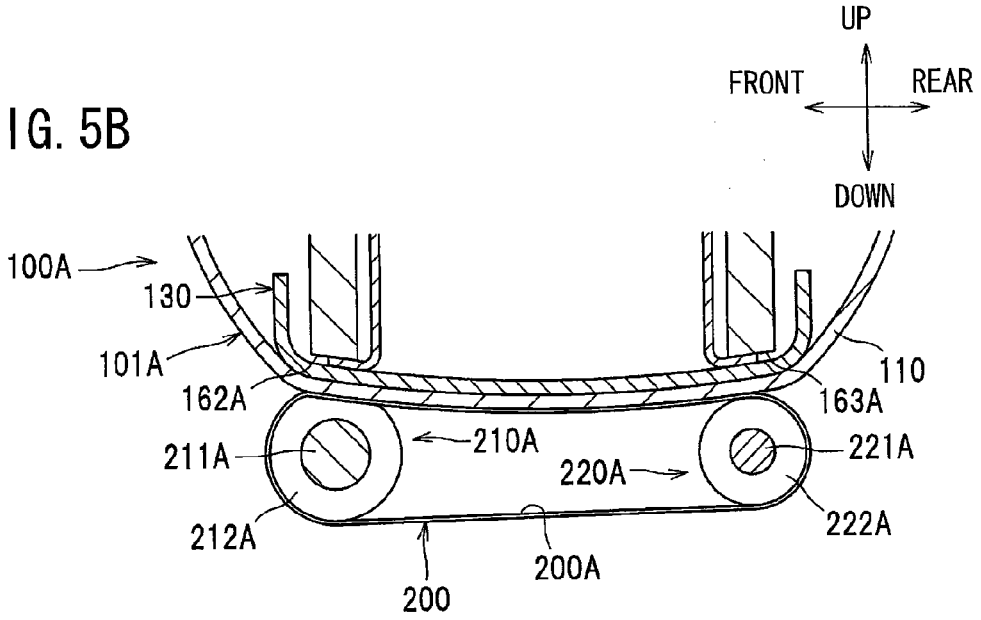
FIG. 5B is a partial cross-sectional view of the fixing device as the fusing belt is in contact with a pressure belt according to the second embodiment.

With this structure, as a coil spring S (not shown) presses the heater 101A toward the pressure belt 200, as shown in FIG. 5B, the reaction force of the first roller 210A can be greater than that from the second roller 220A because the first roller 210A is positioned higher than the second roller 220A. As a result, the pressing force of the first roller 210A can be greater than that of the second roller 220A.

Third Embodiment

Figure 6:
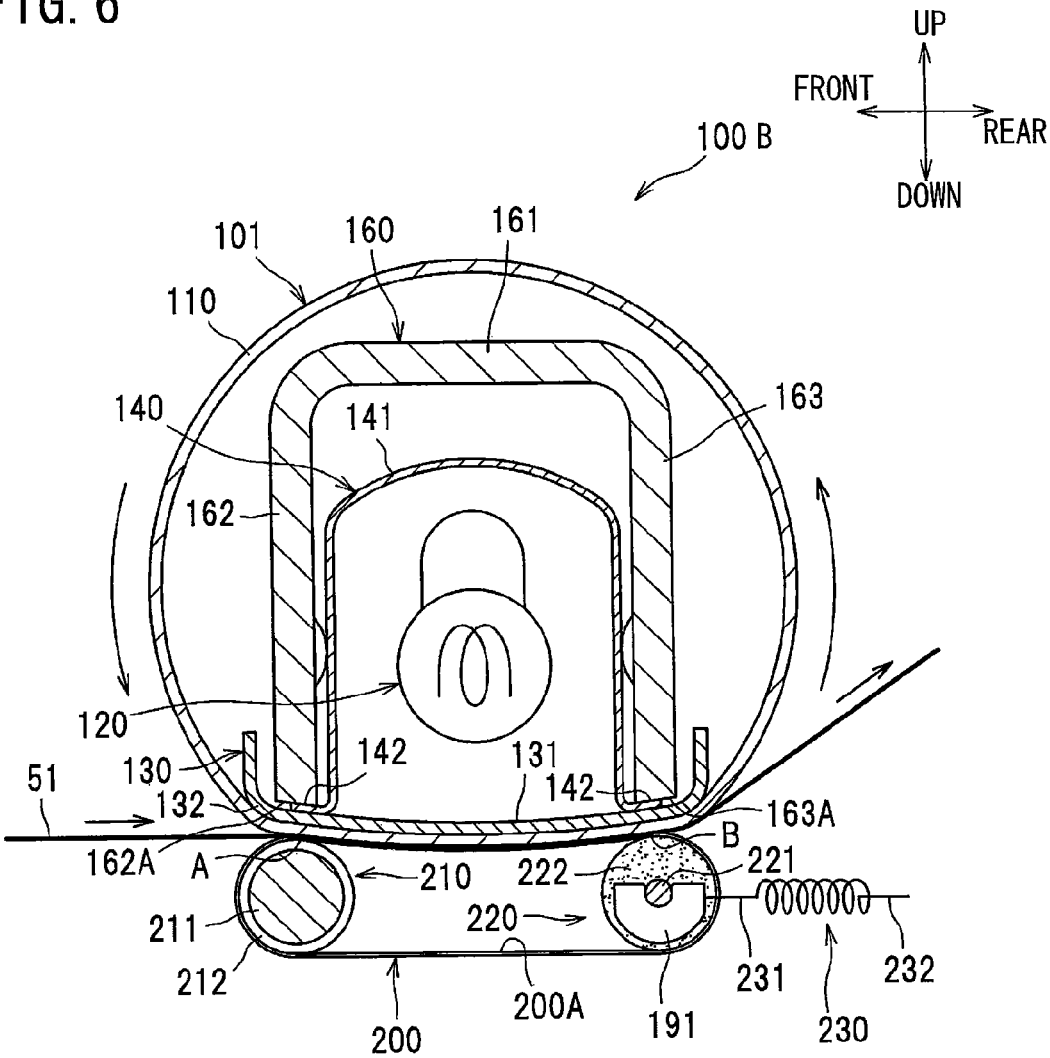
FIG. 6 is a schematic cross-sectional view of a fixing device according to a third embodiment.

A fixing device 100B according to a third embodiment will next be described with reference to FIG. 6. According to the first embodiment, the second roller 220 is coupled to the second gear 223 that is driven by the motor 400 disposed outside. However, according to the third embodiment shown in FIG. 6, the second gear for coupling to the second roller 220 is not provided, that is, the second roller 220 do not receive a drive force from a motor disposed outside. Instead, the first roller 210 receives a drive force from a motor disposed outside. The second roller 220 includes a second shaft 221 and a second elastic layer 222 these being the same as the first embodiment. A coil spring 230 is provided at a bearing 191 rotatably supporting the second shaft 221.

A coil spring 230A has a front end portion 231 hooked on the bearing 191 and a rear end portion 232 hooked on an appropriate location of a fixing frame 180 (See FIG. 4) for urging the second roller 220 in the rearward direction. Therefore, the pressure belt 200 is pulled in the rearward direction, and the pressure belt 200 therefore is constrained from flexing.

Fourth Embodiment

Figure 7:
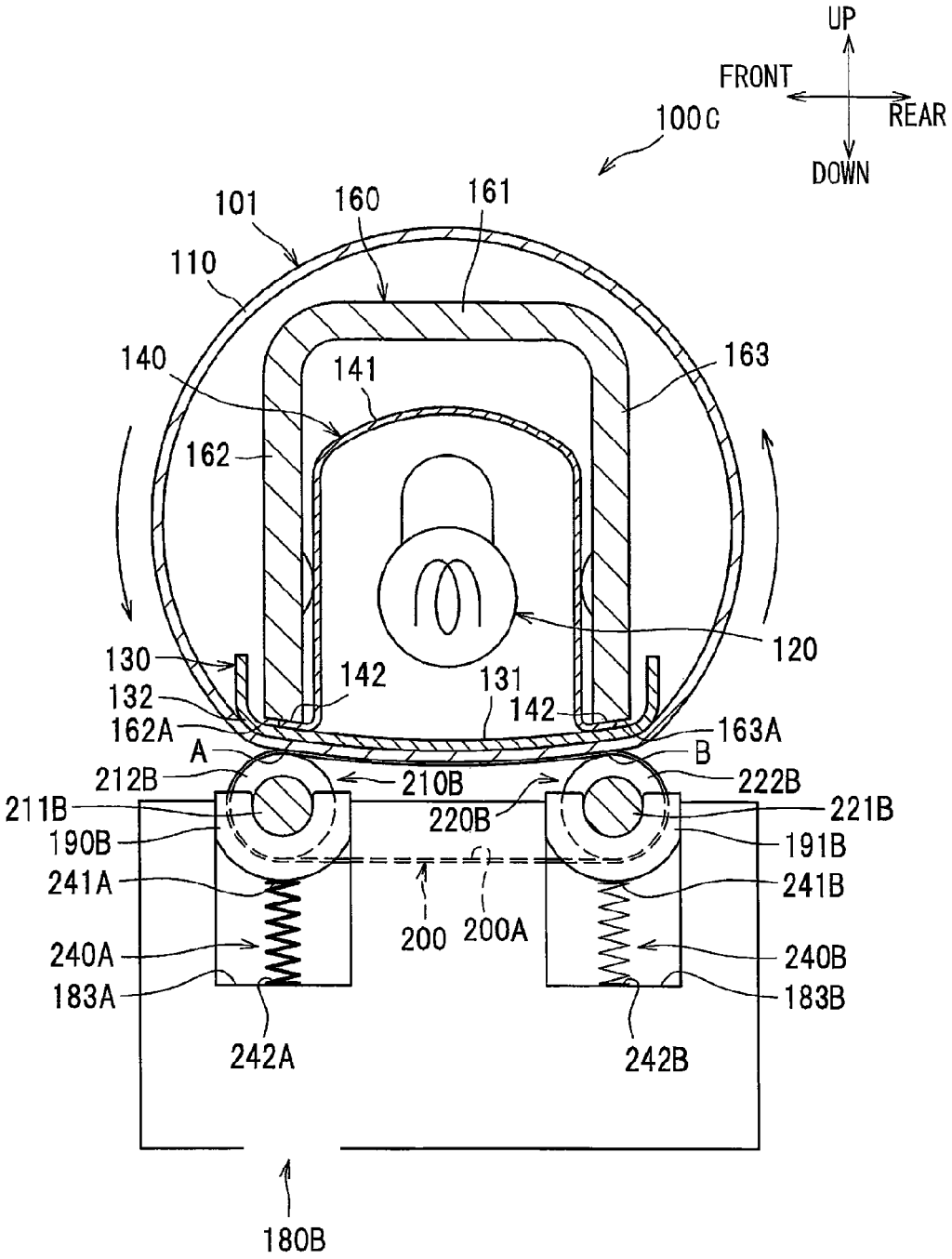
FIG. 7 is a schematic cross-sectional view of a fixing device according to a fourth embodiment.

FIG. 7 shows a fixing device 100C according to a fourth embodiment of the present invention. In the first embodiment, the coil spring S presses the heater 101 in the downward direction for providing the contact pressure in the nip region N. In contrast, according to the fourth embodiment shown in FIG. 7, a first compression spring 240A and a second compression spring 240B are provided instead of the coil spring S.

In a first roller 210B and a second roller 220B, a first elastic layer 212B has a thickness equal to that of a second elastic layer 222B. A first shaft 211B and a second shaft 221B are rotatably supported by bearings 190B and 191B.

A fixing frame 180B is formed with substantially U-shaped support grooves 183A, 183B elongated in the upward direction, and the bearings 190B and 191B are movable with respect to the corresponding support grooves 183A, 183B. The first and second compression springs 240A, 240B are positioned in the U-shaped support grooves 183A, 183B, respectively. More specifically, the first compression spring 240A is interposed between the bearing 190B and the support groove 183A such that an upper end portion 241A of the first compression spring 240A is in contact with the bearing 190B, and a lower end portion 242A of the first compression spring 240A is in contact with a bottom of the support groove 183A for urging the bearing 190B upward. Similarly, the second compression spring 240B is interposed between the bearing 191B and the support groove 183B such that an upper end portion 241B of the second compression spring 240B is in contact with the bearing 191B, and a lower end portion 242B of the second compression spring 240B is in contact with a bottom of the support groove 183B for urging the bearing 191B upward. Thus, the first and second compression springs 240A, 240B are so formed as to urge the bearings 190B, 191B, or the first and second rollers 210B, 220B, toward the heater 101. The urging force of the first compression spring 240A is greater than that of the second compression spring 240B.

With this structure, since the urging force of the first compression spring 240A is greater than that of the second compression spring 240B, the pressing force of the first roller 210B is greater than that of the second roller 220B.

Fifth Embodiment

Figure 8:
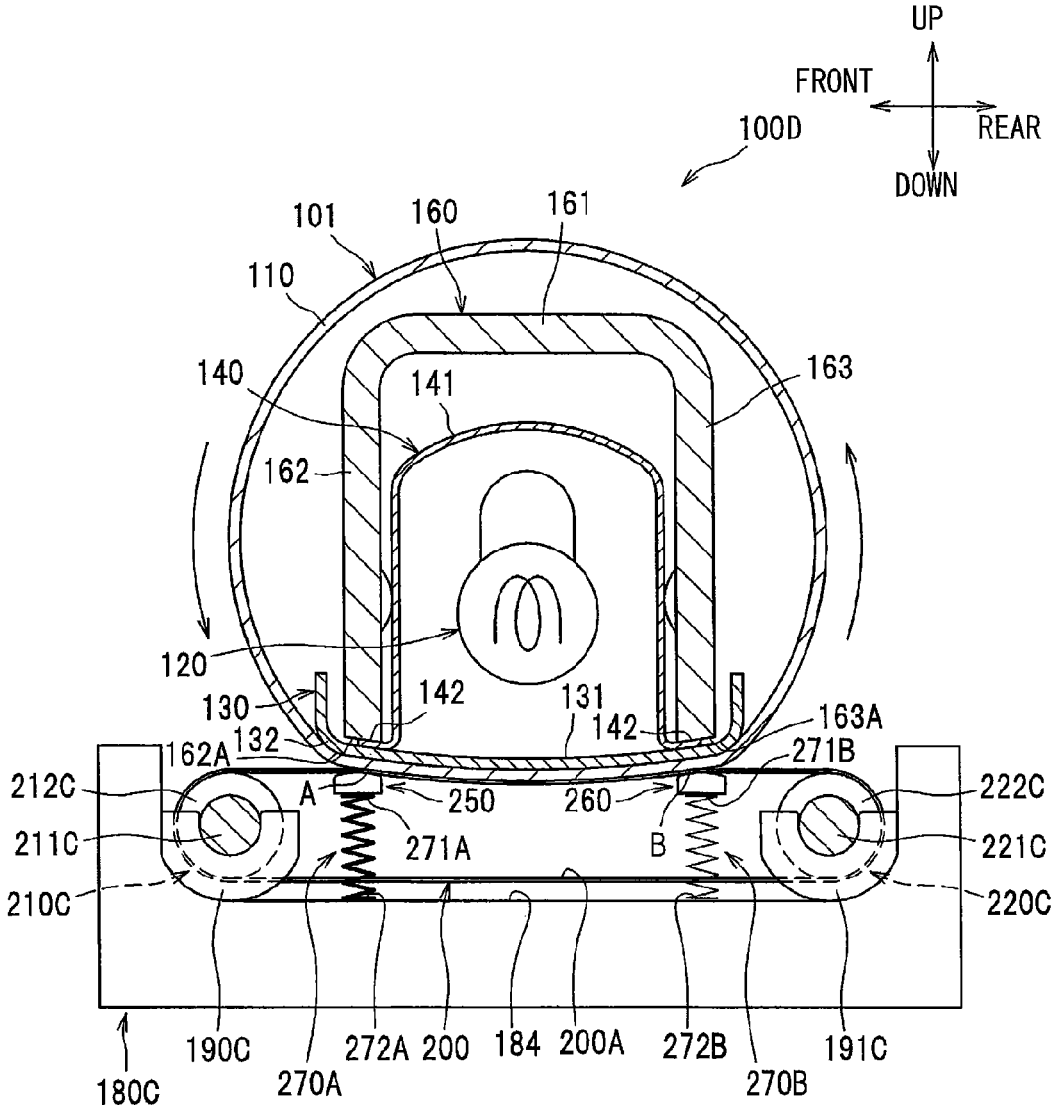
FIG. 8 is a schematic cross-sectional view of a fixing device according to a fifth embodiment.

FIG. 8 shows a fixing device 100D according to a fifth embodiment of the present invention. According to the above described embodiments, the first roller 210 and the second roller 220 are illustrated as a first back up member and a second back up member that press the pressure belt 200 at the positions A and B. In contrast, according to the fifth embodiment shown in FIG. 8, a first pad 250 and a second pad 260 are provided as first and second back up members.

A first roller 210C and a second roller 220C are provided for supporting an inner peripheral surface 200A of the pressure belt 200 similar to the foregoing embodiment. The first and second rollers 210C, 220C have the configuration the same as that in the fourth embodiment. A first shaft 211C and a second shaft 221C are rotatably supported by bearings 190C and 191C, respectively.

A fixing frame 180C is formed with a substantially U-shaped support groove 184 having an upper open end, and the bearings 190C and 191C are fixed to the front and rear end portions of the support groove 184, respectively. First and second compression springs 270A, 270B are provided on the support groove 184 and between the bearings 190C and 191C in the frontward/rearward direction. More specifically, the first compression spring 270A is positioned rearward of the bearings 190C, and the second compression spring 270B is positioned frontward of the bearing 191C.

The first pad 250 is positioned in alignment with the lower surface 162A of the front wall 162, and the second pad 260 is positioned in alignment with the lower surface 163A of the rear wall 163. Further, a pressure belt 200 is nipped between the first pad 250 and the fusing belt 110 at a position A. More specifically, the nip plate 130, the pressure belt 200, and the fusing belt 110 are nipped between the first pad 250 and the lower surface 162A.

The second pad 260 is positioned rearward of the first pad 250 (downstream of the running direction of the pressure belt 200). The pressure belt 200 is nipped between the second pad 260 and the fusing belt 110 at a second position B away from the first position A. More specifically, the nip plate 130, the pressure belt 200, and the fusing belt 110 are nipped between the second pad 260 and the lower surface 163A.

The first compression spring 270A is disposed between the first pad 250 and the support groove 184 such that an upper end portion 271A of the first compression spring 270A is in contact with the first pad 250 and a lower end portion 272A thereof is in contact with the bottom of the support groove 184. The second compression spring 270B is disposed between the second pad 260 and the support groove 184 such that an upper end portion 271B is in contact with the second pad 260, and a lower end portion 272B is in contact with the bottom of the support groove 184. The first compression spring 270A and the second compression spring 270B are so configured to urge the first pad 250 and the second pad 260 toward the heater 101. Here, the urging force of the first compression spring 270A is greater than that of the second compression spring 270B. Thus, the pressing force of the first pad 250 is greater than that of the second pad 260. Incidentally, two first compression springs 270A are provided such that one of the first compression springs 270A is positioned at left side of the pressure belt 200, and another first compression springs 270A is positioned at right side of the pressure belt 200. The same is true with respect to the second compression springs 270B.

Various modifications are conceivable. For example, according to the foregoing embodiments, when viewed in the vertical direction, the first position A is aligned with the lower surface 162A, and the second position B is aligned with the lower surface 163A. However, the first and second positions A and B may not be at the same positions as the lower surfaces 162A and 163A.

In the first embodiment shown in FIG. 2A, the first elastic layer 212 and the second elastic layer 222 are made from materials different from each other, and the second elastic layer 222 has a thickness larger than that of the first elastic layer 212. However, the present invention is not limited to that configuration. For example, the first elastic layer and the second elastic layer can be made from the same material, and the second elastic layer can be thicker than the first elastic layer. Alternatively, the first elastic layer can be equal in thickness to the second elastic layer, and the first elastic layer and the second elastic layer may be a rubber layer and a foamable elastic layer, respectively.

Further, in the second embodiment shown in FIG. 5A, the diameter of the first roller 210A is greater than the diameter of the second roller 220A. However, the present invention is not limited to that configuration. For example, the diameter of the first roller can be equal to the diameter of the second roller, and the top of the first roller can be a higher than the top of the second roller.

Further, according to the foregoing embodiments, the first and second rollers support the inner peripheral surface 200A of the pressure belt 200. However, the present invention is not limited to this configuration. For example, three or more rollers can be used for supporting the pressure belt 200.

Further, according to the foregoing embodiments, the heater includes the fusing belt and the nip plate. However, a heat roller is also available as the heater.

Further, according to the foregoing embodiments, the first roller 210 is driven by the motor 400 disposed outside of the fixing device 100. However, the motor for driving the first roller 210 is not required, if the heater is a heating roller and if the rotation force is imparted on heating roller. In addition, the first roller may not have to be driven by a motor, if driving force is directly imparted on the second roller and provided that slippage of the pressure belt relative to the first roller does not occur.

Further, according to the foregoing embodiments, the first elastic layer 212 is formed over the metallic first shaft 211 in the first roller 210. However, the elastic layer can be dispensed with. Alternatively, a metallic layer and an elastic layer can be formed over a non-metallic shaft member to provide the first roller.

Further, according to the foregoing embodiments, the second roller 220 includes as an outer layer the second elastic layer 222 made from thermally insulating material. However, an elastic layer with no heat insulating characteristic is available as the outer layer.

Further, according to the foregoing embodiments, the pressure belt 200 is made from resin. Instead, the pressure belt 200 can be made from metal.

Further, the foregoing embodiments are applied to the color laser printer 1. However, the present invention is also available to an image forming apparatus other than color laser printer, such as a monochromatic printer, a copying machine and a multifunction device.

While the invention has been described in detail and with reference to specific embodiment thereof, it would be apparent to those skilled in the art that various changes and modifications can be made without departing from the spirit and scope of the invention.

What is claimed is:

1. A fixing device, comprising:

a heater comprising a stay having a first supporting surface and a second supporting surface, and a nip member supported by the stay;

a first endless belt providing a nip region upon contacting the heater, and movable in a first direction at the nip region, the nip member supported by the first supporting surface and the second supporting surface downstream of the first supporting surface in the first direction;

a first back up member providing a first position where the first back up member is configured to nip the first endless belt in cooperation with the first supporting surface and the nip member, the first endless belt and the heater providing a first contact pressure at the first position; and a second back up member positioned downstream of the first back up member in the first direction and spaced away therefrom, the second back up member providing a second position where the second back up member is configured to nip the first endless belt in cooperation with the second supporting surface and the nip member, the first endless belt and the heater providing a second contact pressure at the second position, and the first contact pressure being higher than the second contact pressure.

2. The fixing device according to claim 1, further comprising a first urging member that urges the first back up member against the heater, and a second urging member that urges the second back up member against the heater.

3. The fixing device according to claim 2, wherein the first urging member has an urging force greater than that of the second urging member.

4. The fixing device according to claim 1, wherein the first back up member comprises a first metallic part, and a first elastic layer formed over the first metallic part; and wherein the second back up member comprises a second metallic part, and a second elastic layer formed over the second metallic part, the first metallic part having a thickness smaller than that of the second metallic part.

5. The fixing device according to claim 1, wherein the first back up member comprises a first metallic part and a first elastic layer that is formed over the first metallic part, the first elastic layer being a rubber layer; and wherein the second back up member comprises a second metallic part and a second elastic layer that is formed over the second metallic part, the second elastic layer being an elastic foamable layer.

6. The fixing device according to claim 1, wherein the first back up member has a first top portion, and wherein the second back up member has a second top portion lower than the first top portion when the heater is separated from the first endless belt, assuming that the heater is positioned above the first back up member.

7. The fixing device according to claim 6, further comprising a third urging member configured to urge the heater against the first endless belt, the second top portion is lower than the first top portion when application of urging force from the third urging member is suspended.

8. The fixing device according to claim 1, wherein the heater further comprises a second endless belt configured to make contact with and to be driven by the first endless belt.

9. The fixing device according to claim 8, wherein the nip member is configured to nip the second endless belt between the first endless belt and the nip member, the stay being positioned opposite to the first endless belt with respect to the nip member; and wherein at least one of the first back up member and the second back up member is configured to nip the nip member, the first endless belt and the second endless belt in cooperation with the first supporting surface and the second supporting surface of the stay.

10. The fixing device according to claim 9, wherein the nip member is formed into a plate shape.

11. The fixing device according to claim 1, wherein the first back up member comprises a first roller; and wherein the second back up member comprises a second roller.

12. The fixing device according to claim 11, further comprising a first receiving member configured to receive an external driving force and coupled to the first roller for driving the first roller.

13. The fixing device according to claim 12, further comprising a second receiving member configured to receive the external driving force and coupled to the second roller for driving the second roller.

14. The fixing device according to claim 12, further comprising a fourth urging member that urges the second roller in the first direction.

15. The fixing device according to claim 11, further comprising a second receiving member configured to receive an external driving force and coupled to the second roller for driving the second roller.

16. An image forming apparatus, comprising the fixing device according to claim 15; and wherein the second roller is configured to provide a circumferential velocity higher than that of the first roller.

17. The fixing device according to claim 1, wherein the first endless belt is made from resin.

18. The fixing device according to claim 1, further comprising a reflection plate having a reflecting surface forming a U-shape, the reflecting surface configured to reflect radiant heat generated in the heater, wherein the first back up member is a roller configured to rotate about a first rotation axis positioned upstream of the reflection surface in the first direction, and wherein the second back up member is a roller configured to rotate about a second rotation axis positioned downstream of the reflection surface in the first direction.

* * * * *